US005208129A

United States Patent [19]

Ciccarelli et al.

[11] Patent Number: 5,208,129

[45] Date of Patent: May 4, 1993

[54] PASSIVATED TONER COMPOSITIONS COMPRISING POSITIVE CHARGE ENHANCING ADDITIVE

[75] Inventors: Roger N. Ciccarelli, Rochester; Denise R. Bayley, Fairport, both of N.Y.

[73] Assignee: Xerox Corporation, Stamford, Conn.

[21] Appl. No.: 706,476

[22] Filed: May 28, 1991

[51] Int. Cl.[5] ..... G03G 9/097

[52] U.S. Cl. ..... 430/110; 430/106; 430/106.6; 430/108; 430/109; 430/137; 430/45

[58] Field of Search ..... 430/110, 111, 138, 108, 430/106, 45, 114, 109, 903, 137, 45

[56] References Cited

U.S. PATENT DOCUMENTS

| | | | |
|---|---|---|---|
| 4,078,929 | 3/1978 | Gundlach | 96/1.2 |
| 4,264,185 | 4/1981 | Ohta | 355/4 |
| 4,265,990 | 5/1981 | Stolka et al. | 430/59 |
| 4,525,447 | 6/1985 | Tanaka et al. | 430/122 |
| 4,767,688 | 8/1988 | Hashimoto et al. | 430/110 |
| 4,845,003 | 7/1989 | Kiriu et al. | 430/110 |
| 4,904,762 | 2/1990 | Chang et al. | 430/110 |
| 4,948,686 | 8/1990 | Koch et al. | 430/45 |
| 5,087,538 | 2/1992 | Nelson | 430/45 |

*Primary Examiner*—Marion E. McCamish
*Assistant Examiner*—Rosemary Ashton
*Attorney, Agent, or Firm*—E. O. Palazzo

[57] ABSTRACT

A process for the preparation of passivated toners with a substantially stable positive or negative triboelectric value of from about 10 to about 30 microscoulombs per gram which comprises admixing toner resin particles, colored pigment particles, and a charge enhancing additive; and subsequently adding thereto surface additives wherein the charge additive functions primarily as a passivating component.

20 Claims, No Drawings

PASSIVATED TONER COMPOSITIONS COMPRISING POSITIVE CHARGE ENHANCING ADDITIVE

BACKGROUND OF THE INVENTION

The present invention is generally directed to toners, developers, and imaging process, including a process for forming multi, including two-color, images and more specifically, the present invention is directed to a process for obtaining two-color images which in an embodiment comprises charging an imaging member, creating on the member a latent image comprising areas of high, medium, and low potential, developing the low areas of potential with a developer composition, subsequently developing the high areas of potential with a developer composition, transferring the developed image to a substrate, and optionally permanently affixing the image to the substrate. Another embodiment of the present invention relates to processes for obtaining passivated toners, and more specifically wherein the toner pigments are passivated thereby decreasing, or substantially eliminating their adverse effects on the electrical characteristics of the toner and developer compositions containing such pigments. The toner in embodiments can be comprised of resin particles, a red negatively charged pigment, and a positive charge enhancing additive, such as distearyl dimethylammonium methyl sulfate, and a toner comprised of resin particles, a blue negative charged pigment, and a positive charge enhancing additive, such as distearyl dimethylammonium methyl sulfate; and wherein the pigments selected are passivated. Passivation is achieved by, for example, the admixing of certain colored pigments and charge additives with the toner resin particles. Advantages associated with the processes of the present invention are the ability to generate high quality two-color images in a single development pass, particularly as a result of the absence of interaction between the colored, excluding black, and black developers; and passivation of the toner pigments in embodiments of the present invention. Passivation enables, for example, the selection of a common carrier for a number, such as three colored toner, wherein for each toner the pigment is of a different color and wherein the desired tribocharging level is achieved for each toner; the toners can possess the same, or similar imaging characteristics, especially with common carrier particles; the toners can possess similar triboelectric characteristics, for example a triboelectric value as determined by the known Faraday Cage method, or by a known charge spectrograph, within about + (plus) or − (minus) 10 tribounits, and preferably within about + or −5 tribo units for each toner; each of the toners possesses excellent admix of, for example, from about equal to, or less than 45 seconds, and in embodiments from about 5 to about 15 seconds as determined by the known charge spectrograph, against the same, or similar carrier, enabling developed images with low background deposits; and the electrostatic development apparatus can be the same, or similar for obtaining various different colored images in embodiments. Other advantages associated with the present invention include the provision of a developer with stable negative triboelectrical toner characteristics and stable negative triboelectrically charged toner which enables the generation of high quality images subsequent to development, that is images with substantially no background deposits and substantially no smearing for a broad range of relative humidity conditions, that is, for example, from 20 to 90 percent relative humidity at an effective range of temperature zones ranging, for example, from about 20° C. to about 80° C.

Toner compositions with colored pigments are known. For example, there is disclosed in U.S. Pat. No. 4,948.686, the disclosure of which is totally incorporated herein by reference, a process for the formation of two color images with a colored developer comprised of a first toner comprised of certain resin particles, such as styrene butadiene, a first pigment, such as copper phthalocyanine, a charge control additive, colloidal silica and metal salts of fatty acid external surface additives, and a first carrier comprised of a steel core with, for example, a polymethyl methacrylate overcoating containing known conductive particles of, for example, carbon black, such as BLACK PEARLS® carbon blacks available from Columbia Chemicals, present in an effective amount of, for example, from about 1 to about 40 weight percent of the coating, and wherein the coating weight is, for example, from about 0.2 to 4 weight percent; and a second developer comprised of a black toner, a second charge additive and a steel core carrier with certain polymeric overcoatings, see claim 1 for example. Examples of colored toner pigments are illustrated in column 9, lines 10 to 26, and examples of charge additives for the toner are detailed in column 9, lines 27 to 43, of the aforementioned patent. For the black toner, there can be selected the components as recited in columns 10 and 11, including charge additives such as distearyl dimethyl ammonium methyl sulfate, see column 11, lines 16 to 32. Additionally, the working Examples of this patent detail the preparation of a number of specific toners. More specifically, there is illustrated in U.S. Pat. No. 4,948,686 a process for forming two-color images which comprises, for example, (1) charging an imaging member in an imaging apparatus; (2) creating on the member a latent image comprising areas of high, intermediate, and low potential; (3) developing the low areas of potential by conductive magnetic brush development with a developer comprising a colored first toner comprising a first resin present in an amount of from about 80 to about 98.8 percent by weight and selected from the group consisting of polyesters, styrene-butadiene polymers, styrene-acrylate polymers, styrenemethacrylate polymers, and mixtures thereof; a first pigment present in an amount of from about 1 to about 15 percent by weight and selected from the group consisting of copper phthalocyanine pigments, quinacridone pigments, azo pigments, rhodamine pigments, and mixtures thereof; a charge control agent present in an amount of from about 0.2 to about 5 percent by weight; colloidal silica surface external additives present in an amount of from about 0.1 to about 2 percent by weight; and external additives comprising metal salts or metal salts of fatty acids present in an amount of from about 0.1 to about 2 percent by weight; and a first carrier comprising a steel core with an average diameter of from about 25 to about 215 microns and a coating selected from the group consisting of a methyl terpolymer, polymethyl methacrylate, and a blend of from about 35 to about 65 percent by weight of polymethyl methacrylate and from about 35 to about 65 percent by weight of chlorotrifluoroethylene-vinyl chloride copolymer, wherein the coating contains from 0 to about 40 percent by weight of the coating of conductive particles and wherein the coating weight is from about 0.2 to about 3 percent by weight of the carrier; (4) subsequently developing the high areas of potential by conductive magnetic brush development with a developer comprising a black second toner comprising a second resin present in an amount of from about 80 to about 98.8 percent by weight and selected from the group consisting of polyesters, styrene-butadiene polymers, styrene-acrylate polymers, styrene-methacrylate polymers, and mixtures thereof; a second pigment present in an amount of from about 1 to about 15 percent by weight; and a second charge control additive present in an amount of from about 0.1 to about 6 percent by weight; and a second carrier comprising a steel core with an average diameter of from about 25 to about 215 microns and a coating selected from the group consisting of a chlorotrifluoroethylene-vinyl chloride copolymer containing from 0 to about 40 percent by weight of conductive particles at a coating weight of from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier; and (5) transferring the developed twocolor image to a substrate. Imaging members suitable for use with the process of the copending application may be of any type capable of maintaining three distinct levels of potential. Generally, various dielectric or photoconductive insulating material suitable for use in xerographic, ionographic, or other electrophotographic processes may be selected for the above process, and suitable photoreceptor materials include amorphous silicon, layered organic materials as disclosed in U.S. Pat. No. 4,265,990, the disclosure of which is totally incorporated herein by reference, and the like. One disadvantage associated with the toners and imaging processes of the aforementioned patent include the use of a positive charged pigment, and a positive charge enhancing additive resulting, it is believed, in images with lower resolutions that are obtained with the invention of the present application in embodiments.

Processes for obtaining electrophotographic, including xerographic, and two-colored images are known. In U.S. Pat. No. 4,264,185, the disclosure of which is totally incorporated herein by reference, there is illustrated an apparatus for forming two color images by forming a bipolar electrostatic image of a two-color original document on a photoconductive drum. A first developing unit applies a toner of a first color and polarity to the drum and a second developing unit applies a toner of a second color and polarity to the drum to form a two color electrostatic image which is transferred and fixed to a copy sheet. A bias voltage of the first polarity is applied to the second developing unit to repel the toner of the first color and prevent degradation of the first color toner image. A bias voltage of the second polarity is applied to the first developing unit to prevent contamination of the first color toner with the second color toner.

In U.S. Pat. No. 4,308,821, there is disclosed a method and apparatus for forming two-color images which employs two magnetic brushes. The first developed image is not disturbed during development of the second image since the second magnetic brush contacts the surface of the imaging member more lightly than the first magnetic brush, and the toner scraping force of the second magnetic brush is reduced in comparison with that of the first magnetic brush by setting the magnetic flux density on a second nonmagnetic sleeve with an internally disposed magnet smaller than the magnetic flux density on a first magnetic sleeve, or by adjusting the distance between the second nonmagnetic sleeve and the surface of the imaging member.

Further, U.S. Pat. No. 4,378,415, the disclosure of which is totally incorporated herein by reference, illustrates a method of highlight color imaging which comprises providing a layered organic photoreceptor having a red sensitive layer and a short wavelength sensitive layer, subjecting the imaging member to negative charges, followed by subjecting the imaging member to positive charges, imagewise exposing the member, and developing with a colored developer composition comprising positively charged toner components, negatively charged toner components and carrier particles. In U.S. Pat. No. 4,430,402, there is illustrated a two-component type dry developer for use in dichromatic electrophotography which comprises two kinds of developers, each of which consists of a toner and a carrier. Dichromatic images are formed by developing a both positively and negatively electrified electrostatic latent image successively with toners different in polarity and color from each other, wherein one carrier becomes positively charged by friction with either of the two toners while the other carrier becomes negatively charged by friction with either of the two toners.

Additionally, U.S. Pat. No. 4,594,302 discloses a developing process for two-colored electrophotography which comprises charging the surface of a photoreceptor with two photosensitive layers of different spectral sensitivities with one polarity, subsequently charging the photoreceptor with a different polarity, exposing a two-colored original to form electrostatic latent images having different polarities corresponding to the two-colored original, developing one latent image with a first color toner of one polarity, exposing the photoreceptor to eliminate electric charges with the same polarity as the first color toner which are induced on the surface of the photoreceptor in the vicinity of the latent image developed by the first color toner, and developing the other latent image with a second color toner charged with a polarity different from that of the first color toner.

Moreover, U.S. Pat. No. 4,500,616 discloses a method of developing electrostatic latent images by selectively extracting colored grains of one polarity from a mixture thereof having opposite polarity to each other in the presence of an alternating field, followed by development of the electrostatic image by the selectively extracted colored grains. Additionally, U.S. Pat. No. 4,524,117 discloses an electrophotographic method for forming two-colored images which comprises uniformly charging the surface of a photoreceptor having a conductive surface and a photoconductive layer sensitive to a first color formed on the conductive substance, followed by exposing a two-colored original to form on the photoconductive layer a latent image corresponding to a second color region in the original with the same polarity as the electric charges on the surface of the photoconductive layer. The photoreceptor surface is then subjected to a reversal development treatment by the use of a photoconductive color toner charged with the same polarity as the electric charges constituting the latent image to develop the noncharged region with the photoconductive toner. The latent image is then subjected to normal development treatment with an insulative toner having a color different from the color of the photoconductive toner. Subsequently, the color toners on the photoconductive layer are charged with a different polarity from the charging polarity and, simultaneously, the original is exposed through a filter shielding against the first color, thereby forming a two-colored image.

Furthermore, in U.S. Pat. No. 4,525,447, the disclosure of which is totally incorporated herein by reference, there is illustrated an image forming method which comprises forming on a photosensitive member an electrostatic latent image having at least three different levels of potentials, or comprising first and second latent images and developing the first and second latent images with a three component developer. The developer comprises a magnetic carrier, a first toner chargeable to one polarity by contact with the magnetic carrier, and a second toner chargeable to a polarity opposite to that of the first toner by contact with the first toner, but substantially not chargeable by contact with the magnetic carrier. Also, U.S. Pat. No. 4,539,281 discloses a method of forming dichromatic copy images by forming an electrostatic latent image having a first image portion and a second image portion. The first image portion is developed by a first magnetic brush with a magnetic toner of a first color that is chargeable to a specific polarity, and the second image portion is developed by a second magnetic brush with a mixture of a magnetic carrier substantially not chargeable with the magnetic toner and a nonmagnetic toner of a second color chargeable to a polarity opposite to that of the magnetic toner by contact with the magnetic carrier.

Additionally, U.S. Pat. No. 4,562,129, the disclosure of which is totally incorporated herein by reference, illustrates a method of forming dichromatic copy images with a developer composed of a high-resistivity magnetic carrier and a nonmagnetic insulating toner, which are triboelectrically chargeable. An electrostatic latent image having at least three different levels of potential is formed and the toner and carrier are adhered, respectively, onto the first and second image portions. In addition, U.S. Pat. No. 4,640,883, the disclosure of which is totally incorporated herein by reference, illustrates a method of forming composite or dichromatic images which comprises forming on an imaging member electrostatic latent images having at least three different potential levels, the first and second latent images being represented, respectively, by a first potential and a second potential relative to a common background potential. The first and second images are developed by a first magnetic brush using two kinds of toners, at least one of which is magnetic, and both of which are chargeable to polarities opposite to each other with application to a developing electrode of a bias voltage capable of depositing the magnetic toner on the background potential area to deposit selectively the two toners on the first and second latent images and to deposit the magnetic toner on the background potential area, while collecting the deposited magnetic toner at least from the background potential area by second magnetic brush developing means.

Also mentioned are the following U.S. Patents: U.S. Pat. No. 4,845,004 directed to hydrophobic silicon type micropowders comprising silicon type microparticles which have been treated with secondary tertiary amine functional silanes, and when the micropowders combine with the positively charging resin powder, such as a toner, the fluidity of the resin powder is substantially increased, see for example the Abstract of the Disclosure, column 1, beginning at line 60, and continuing on to column 4 and the working Examples; U.S. Pat. No. 4,758,491 directed to dry toner and developer compositions with good charge stability and minimization of toner image transfer defects, which composition comprises a major component of a normally solid fixable binder resin which is free of siloxane segments and is a minor component in a normally solid multiphase thermoplastic condensate polymer which contains a polyorgano siloxane block or graft segment, note specifically the use of a charge control agent in column 2, beginning at line 50, examples of charge control agents being detailed, for example, in column 4, beginning at line 23, including ammonium or phosphonium salts, and the like; U.S. Pat. No. 4,845,003, the disclosure of which is totally incorporated herein by reference, directed to a toner for developing electrostatic latent images characterized in that the toner comprises an aluminum complex of a hydroxy carboxylic acid which may be substituted with alkyl and/or arylalkyl, such as BONTRON E-88 TM, E-84 TM, and the like, see for example column 2, beginning at line 29, and continuing on to column 5; and U.S. Pat. No. 4,855,208 directed to a toner for developing electrostatic latent images, which toner comprises an aluminum compound of an aromatic amino carboxylic acid as represented by the formula illustrated in the Abstract of the Disclosure, and also see column 2, beginning at line 26, and continuing on to column 7.

Other representative patents of interest with respect to formation of two-color images include U.S. Pat. Nos. 4,045,218 and 4,572,651.

The process of charging a photoresponsive imaging member to a single polarity and creating on it an image of at least three different levels of potential of the same polarity is described in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area with the second and third areas functioning as image areas. The charge pattern is developed in a first step with positively charged toner particles of a first color, and in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the trilevel process for generating images is U.S. Pat. No. 4,686,163, the disclosure of which is totally incorporated herein by reference. The aforementioned processes may be selected with the passivated toners and developers of the present invention.

The photoresponsive imaging member can be negatively charged, positively charged, or both, and the latent image formed on the surface may be comprised of either a positive or a negative potential, or both. In one embodiment, the image comprises three distinct levels of potential, all being of the same polarity. The levels of potential should be well differentiated, such that they are separated by at least 100 volts, and preferably 200 volts or more. For example, a latent image on an imaging member can comprise areas of potential at −800, −400, and −100 volts. In addition, the levels of potential may comprise ranges of potential. For example, a latent image may be comprised of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ, depending upon the type of imaging member selected.

Moreover, illustrated in U.S. Pat. No. 5,075,185, the disclosure of which is totally incorporated herein by reference, are developers, toners and imaging processes thereof. In an embodiment of the patent, there is provided a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin particles, colored, other than black, pigment particles, and an aluminum complex charge enhancing additive; (4) subsequently developing the high areas of potential by conductive magnetic brush development with a developer comprising a second black developer comprised of carrier particles and a toner comprised of resin, black pigment, such as carbon black, and a charge enhancing additive; (5) transferring the developed two-color image to a suitable substrate; and (6) fixing the image thereto. In an embodiment of the aforementioned, the first developer comprises, for example, a first toner comprised of resin present in an effective amount of from, for example, about 70 to about 98 percent by weight which resin can be selected from the group consisting of polyesters, styrene-butadiene polymers, styrene-acrylate polymers, styrene-methacrylate polymers, PLIOLITES ®, crosslinked styrene acrylates, crosslinked styrene methacrylates, and the like, wherein the crosslinking component is, for example, divinyl benzene, and mixtures thereof; a first colored blue, especially PV FAST BLUE TM pigment present in an effective amount of from, for example, about 1 to about 15 percent by weight, and preferably from about 5 to about 10 weight percent; an aluminum complex charge enhancing additive; and a second developer comprised of a second toner comprised of resin present in an effective amount of from, for example, about 70 to about 98 percent by weight, which resin can be selected from the group consisting of polyesters, styrene-butadiene polymers, styrene-acrylate polymers, styrene-methacrylate polymers, PLIOLITES ®, crosslinked styrene acrylates, crosslinked styrene methacrylates, and the like, wherein the crosslinking component is, for example, divinyl benzene, and mixtures thereof; and a black pigment present in an effective amount of from, for example, about 1 to about 15 percent by weight, and preferably from about 1 to about 5 weight percent wherein the aforementioned black toner contains a charge enhancing additive such as an alkyl pyridinium halide, and preferably cetyl pyridinium chloride, and in a preferred embodiment the black toner is comprised of 92 percent by weight of a styrene n-butyl methacrylate copolymer (58/42), 6 percent by weight of Regal 330 ® carbon black, and 2 percent by weight of the charge enhancing additive cetyl pyridinium chloride.

Illustrated in U.S. Pat. No. 5,087,538, the disclosure of which is totally incorporated herein by reference, is a process for forming two-color images which comprises (1) charging an imaging member in an imaging apparatus; (2) creating on the member a latent image comprising areas of high, intermediate, and low potential; (3) developing the low areas of potential by, for example, conductive magnetic brush development with a developer comprising carrier particles, and a colored first toner comprised of resin, a positively charging pigment, and a negatively charging pigment; (4) subsequently developing the high areas of potential by conductive magnetic brush development with a developer comprising a second developer comprised of carrier particles and a toner comprised of resin, black pigment, such as carbon black, and a charge enhancing additive; (5) transferring the developed two-color image to a suitable substrate; and (6) fixing the image thereto.

SUMMARY OF THE INVENTION

It is a feature of the present invention to provide toner and developer compositions, and imaging processes thereof.

It is another feature of the present invention to provide imaging processes for obtaining multi, such as two-color images, and discharge area development images, that is, for example, wherein the background areas of a charged layered imaging member can be developed.

It is another feature of the present invention there are provided passivated toner compositions.

In still another feature of the present invention there are provided passivated colored toner pigments, thereby enabling toners with stable triboelectrical characteristics.

Another feature of the present invention is to provide a process for forming two-color images wherein the first developer does not discharge the latent image to be developed by the second developer.

Another feature of the present invention is to provide a two-color image formation process wherein the developers are of specified triboelectric charge, charge distribution, and conductivity, and exhibit acceptable admix times and excellent developer lifetimes.

Moreover, in another feature of the present invention there are provided colored toners and developers with different colors, which toners that can be used interchangeably with the same, or similar carrier particles.

In another feature of the present invention there are provided colored toners and developers with different colors, which toners can be used interchangeably with the same carrier for development, and wherein excellent quality images can be obtained in embodiments.

These and other features of the present invention can be accomplished by providing developers, toners and imaging processes thereof. In an embodiment of the present invention there is provided a process for the formation of passivated toners which comprises admixing toner resin particles, colored pigment particles, such as Lithol Scarlet like LITHOL SCARLET D3700 TM available from BASF, and Hostaperm Pink, especially HOSTAPERM PINK E TM available from BASF, and thereafter blending therewith a positive, or negative charge enhancing additive, followed by the addition of known surface additives. A second passivated toner can be prepared in a similar manner with the exception that there is selected as the colored pigment a blue pigment, such as NEOPEN BLUE TM or SUDAN BLUE TM available from American Hoechst. Developers can be prepared by admixing the aforementioned toners with known carriers, such as steel, which is usually coated with a polymer, such as polymethylacrylate, and wherein the coating contains conductive particles, such as carbon black, like VULCAN ® carbon black available from Cabot Corporation.

In an embodiment of the present invention, a red passivated toner is prepared by blending together in a suitable known vessel a red pigment with a negative tribo charge with a positively charging charge control additive in such a ratio, such as 7:1, to achieve the desired admix as indicated herein, such as for example from about 15 to about 30 seconds, and stable toner tribo characteristics as indicated herein, and more specifically about −17 microcoulombs per gram with a specific carrier comprised, for example, of a steel core with a 0.8 weight percent coating of polymethylacrylate containing conductive particles, for example about 20 weight percent of carbon black. The toner components can be blended in a Lodige Blender, attrited, micronized, and classified to provide toner particles with an average particle volume diameter of from about 9 to about 20, and preferably from about 10 to about 15 microns. In an embodiment, there may be blended a blue pigment with a positive charge and a negatively charging charge control additive, such as an aluminum complex, as illustrated in U.S. Pat. No. 4,845,003, the disclosure of which is totally incorporated herein by reference, like BONTRON E-88 TM available from Orient Chemicals of Japan. In one embodiment, passivation was determined to be achieved since a toner with a red pigment and a positive charge control additive, and a blue toner with a negative charge control additive both had a −17 triboelectric charge, and about a 30 second admix rate against the aforementioned steel coated carrier.

The developers of the present invention can be selected for forming two-color images which comprise (1) charging an imaging member in an imaging apparatus; (2) creating on the member a latent image comprising areas of high, intermediate, and low potential; (3) developing the low areas of potential by, for example, conductive magnetic brush development with a developer of this invention comprising carrier particles, and a passivated colored, for example, red, or blue toner as illustrated herein; (4) subsequently developing the high areas of potential by conductive magnetic brush development with a developer comprising a second developer comprised of carrier particles and a toner comprised of resin, black pigment, such as carbon black, and a charge, especially positive enhancing additive; (5) transferring the developed two-color image to a suitable substrate; and (6) fixing the image thereto.

Examples of selected resin particles for the passivated red and blue toners of the present invention include styrene acrylates, styrene methacrylates, polyesters, crosslinked styrene methacrylates, and styrene butadienes, especially those with a high, such as from about 80 to about 98 weight percent, styrene content like the commercially available Goodyear PLIOLITES ®, PLIOTONES ®, and the like. The resin is present in an effective amount of from, for example, about 70 to about 98 percent by weight, which resin can be a styrene butadiene with from about 89 to about 92 weight percent of styrene. Typical toner resins include styrene butyl methacrylates, linear polyesters, styrene-butadiene polymers, particularly styrene-butadiene copolymers wherein styrene is present in an amount of from about 83 to about 93 percent by weight, and preferably about 88 percent by weight, and butadiene is present in an amount of from about 7 to about 17 percent by weight, and preferably about 12 percent by weight, such as resins commercially available as Pliolite ® or Pliotone ® from Goodyear. Also suitable are styrene-n-butylmethacrylate polymers, particularly those styrene-n-butylmethacrylate copolymers wherein the styrene segment is present in an amount of from about 50 to about 70 percent by weight, preferably about 58 percent by weight, and the n-butylmethacrylate portion is present in an amount of from about 30 to about 50 percent by weight, preferably about 42 percent by weight. Mixtures of these resins are also suitable. Furthermore, suitable are styrene-n-butylmethacrylate polymers wherein the styrene portion is present in an amount of from about 50 to about 80 percent by weight, and preferably about 65 percent by weight, and the n-butylmethacrylate portion is present in an amount of from about 50 to about 20 percent by weight, and preferably about 35 percent by weight.

Examples of red pigments include Lithol Scarlet, especially Lithol Scarlet D3700 TM, Lithol Fast Scarlet L4300 TM, Lithol Scarlet K4165 TM, Lithol Rubine NB04573 TM, Hostaperm Pink E TM, mixtures thereof, and the like, such as those pigments that are negatively charged. The aforementioned pigments are present in various effective amounts, such as for example from about 2 to about 15 weight percent, and preferably from about 5 to about 10 weight percent. Examples of blue pigments present in various effective amounts, such as illustrated herein with reference to the red pigments, and more specifically from about 2 to about 15 weight percent in preferred embodiments, include NEOPEN BLUE TM NB802, SUDAN BLUE OS TM, and the like. Also, mixtures of NEOPEN BLUE TM and HOSTAPERM PINK TM, mixtures of SUDAN BLUE OS TM and HOSTAPERM PINK TM, for example from about 8 to about 10 of the blue and from about 1 to about 2 of the pink, mixtures of NEOPEN BLUE TM and LITHOL RUBINE TM, for example from about 8 to about 10 of the blue and from about 1 to about 2 of the RUBINE TM, mixtures of SUDAN BLUE TM and LITHOL RUBINE TM for example from about 8 to about 10 of the blue and from about 1 to about 2 of the RUBINE TM, and the like, can be selected.

Charge enhancing additives, which are present in the toner in various effective amounts, such as from about 1 to about 20, and preferably from about 0.5 to about 5 weight percent include known additives such as distearyl dimethyl ammonium methyl sulfate, cetyl pyridinium halide, especially the chloride, bisulfides, and mixtures thereof. Examples of specific charge additives include alkyl pyridinium halides, and preferably cetyl pyridinium chloride, reference U.S. Pat. No. 4,298,672, the disclosure of which is totally incorporated herein by reference, organic sulfates and sulfonates, reference U.S. Pat. No. 4,338,390, the disclosure of which is totally incorporated herein by reference, distearyl dimethyl ammonium methyl sulfate (DDAMS), reference U.S. Pat. No. 4,560,635, the disclosure of which is totally incorporated herein by reference, and the like. This toner can possess a negative, or positive charge of from about 10 to about 45 microcoulombs per gram and preferably from about 15 to about 25 microcoulombs per gram, which charge is dependent on a number of known factors including the amount of charge enhancing additive present and the exact composition of the other compositions such as the toner resin, passivation, the pigment, the carrier core, and the coating selected for the carrier core, and an admix time of from about 15 to about 60 seconds and preferably from about 15 to about 30 seconds. Examples of a negative charge additive include the aluminum complexes mentioned herein, such as BONTRON E-88 TM and E-84 TM, available from Orient Chemical Company of Japan, and other known negative charge enhancing additives.

In the preparation of the colored and toner compositions, normally the products obtained comprised of toner resin, pigment and charge enhancing additive can be subjected to micronization and classification, which classification is primarily for the purpose of removing undesirable fines, and substantially very large particles to enable, for example, toner particles with an average volume diameter of from about 5 to about 25 microns and preferably from about 10 to about 20 microns. The aforementioned toners may include as surface or external components additives in an effective amount of, for example, from about 0.1 to about 3 weight percent, such as colloidal silicas, such as AEROSIL ® R972, metal salts, metal salts of fatty acids, especially zinc stearate, reference for example U.S. Pat. Nos. 3,590,000; 3,655,374; 3,900,588 and 3,983,045, the disclosures of which are totally incorporated herein by reference, metal oxides and the like for the primary purpose of controlling toner conductivity and powder flowability. Examples of specific external additives of colloidal silica, include Aerosil ® R972, Aerosil ® R976, Aerosil ® R812, and the like, available from Degussa, and metal salts or metal salts of fatty acids, such as zinc stearate, magnesium stearate, aluminum stearate, cadmium stearate, and the like, which additives may be blended on the surface of the colored toners. These additives are disclosed in the prior art such as U.S. Pat. Nos. 3,590,000; 3,720,617; 3,900,588 and 3,983,045, the disclosures of each of which are totally incorporated herein by reference. Generally, the silica is present in an amount of from about 0.1 to about 2 percent by weight, and preferably about 0.3 percent by weight of the toner, and the stearate is present in an amount of from about 0.1 to about 2 percent by weight, and preferably about 0.3 percent by weight, of the toner. Varying the amounts of these two external additives enables adjustment of the charge levels and conductivities of the toners. For example, increasing the amount of silica generally adjusts the triboelectric charge in a negative direction and improves admix times, which are a measure of the amount of time required for fresh toner to become triboelectrically charged after coming into contact with a carrier. In addition, increasing the amount of stearate improves admix times, renders the developer composition more conductive, adjusts the triboelectric charge in a positive direction, and improves humidity insensitivity.

The carrier for the colored developer in an embodiment of the present invention can be comprised of a steel core with an average diameter of from about 25 to about 225 microns, and a coating thereover, such as for example, selected from the group consisting of methyl terpolymer, polymethyl methacrylate, and a blend of from about 35 to about 65 percent by weight of polymethyl methacrylate and from about 35 to about 65 percent by weight of chlorotrifluoroethylene-vinyl chloride copolymer wherein the coating contains from 0 to about 40 percent by weight of the coating conductive particles, such as carbon black, and wherein the coating weight is from about 0.2 to about 3 percent by weight of the carrier. The carrier for the black developer can be comprised of a steel core with an average diameter of from about 25 to about 225 microns and a coating thereover, such as for example, selected from the group consisting of chlorotrifluoroethylene-vinyl chloride copolymer containing from 0 to about 40 percent by weight of conductive particles and wherein the coating weight is from about 0.4 to about 1.5 percent by weight of the carrier; polyvinylfluoride at a coating weight of from about 0.01 to about 0.2 percent by weight of the carrier; and polyvinylchloride at a coating weight of from about 0.01 to about 0.2 percent by weight of the carrier. In embodiments, the carrier particles can be conductive, and exhibit in an embodiment of the present invention a conductivity of, for example, from about $10^{-14}$ to about $10^{-6}$, and preferably from about $10^{-11}$ to about $10^{-7}$ (ohm-cm)$^{-1}$. Conductivity is generally controlled by the choice of carrier core and coating by partially coating the carrier core, or by coating the core with a coating containing carbon black the carrier is rendered conductive. In addition, irregularly shaped carrier particle surfaces and toner concentrations of from about 0.2 to about 5 will generally render a developer conductive. Addition of a surface additive such as zinc stearate to the surface of the toner particles also renders a developer conductive with the level of conductivity rising with increased concentrations of the additive. Other carriers, including those with conductivities not specifically mentioned, may also be selected, including the carriers as illustrated in U.S. Pat. No. 4,883,736, the disclosure of which is totally incorporated herein by reference, and U.S. Pat. Nos. 4,937,166 and 4,935,326, the disclosures of which are totally incorporated herein by reference. The aforementioned carriers in one embodiment comprise a core with two polymer coatings not in close proximity in the triboelectric series.

More specifically, the carrier for the developers of the present invention generally can comprise a ferrite, iron or a steel core, preferably unoxidized, such as Hoeganes Anchor Steel Grit, with an average diameter of from about 25 to about 215 microns, and preferably from about 50 to about 150 microns. These carrier cores can be coated with a solution coating of methyl terpolymer, reference for example U.S. Pat. Nos. 3,467,634 and 3,526,533, the disclosure of which is totally incorporated herein by reference, containing from 0 to about 40 percent by weight of conductive particles such as carbon black or other conductive particles as disclosed in U.S. Pat. No. 3,533,835, the disclosure of which is totally incorporated herein by reference, with the coating weight being from about 0.2 to about 3 percent by weight of the carrier, and preferably from about 0.4 to about 1.5 percent by weight of the carrier. Also, the carrier coating may comprise polymethyl methacrylate containing conductive particles in an amount of from 0 to about 40 percent by weight of the polymethyl methacrylate, and preferably from about 10 to about 20 percent by weight of the polymethyl methacrylate, wherein the coating weight is from about 0.2 to about 3 percent by weight of the carrier and preferably about 0.8 percent by weight of the carrier. Another carrier coating for the carrier of the colored developer comprises a blend of from about 35 to about 65 percent by weight of polymethyl methacrylate and from about 35 to about 65 percent by weight of chlorotrifluoroethylene-vinyl chloride copolymer, commercially available as OXY 461® from Occidental Petroleum Company and containing conductive particles in an amount of from 0 to about 40 percent by weight, and preferably from about 20 to about 30 percent by weight, wherein the coating weight is from about 0.2 to about 3 percent by weight of the carrier, and preferably about 1 percent by weight of the carrier. Excellent solid area development, and excellent line copy development can be obtained when the aforementioned carriers are selected in embodiments of the present invention. Also, the developer of the present invention with passivated toner can possess in embodiments stable electrical characteristics for extended time periods of up to six months.

The triboelectric charge of the colored toners can vary depending on the developer components for example; generally, however, the tribo as determined by the known charge spectrograph is from about a negative 10 to about 30, and preferably from about a negative 15 to about 20 microcoulombs per gram; and the admix time of uncharged freshly added toner is from about 15 to about 60, and preferably about 30 seconds as determined by the known charge spectrograph.

By passivation in embodiments is meant minimizing, or avoiding any adverse effects on the toner tribo charge by the pigment.

Examples of imaging members selected for the processes of the present invention may be of any type capable of maintaining three distinct levels of potential. Generally, various dielectric or photoconductive insulating material suitable for use in xerographic, ionographic, or other electrophotographic processes may be used, such as amorphous silicon, layered organic materials as disclosed in U.S. Pat. No. 4,265,990, the disclosure of which is totally incorporated herein by reference, and the like.

The photoresponsive imaging member can be negatively charged, positively charged, or both, and the latent image formed on the surface may be comprised of either a positive or a negative potential, or both. In one embodiment, the image consists of three distinct levels of potential, all being of the same polarity. The levels of potential should be well differentiated, such that they are separated by at least 100 volts, and preferably 200 volts or more. For example, a latent image on an imaging member can be comprised of areas of potential at −800, −400, and −100 volts. In addition, the levels of potential may consist of ranges of potential. For example, a latent image may consist of a high level of potential ranging from about −500 to about −800 volts, an intermediate level of potential of about −400 volts, and a low level ranging from about −100 to about −300 volts. An image having levels of potential that range over a broad area may be created such that gray areas of one color are developed in the high range and gray areas of another color are developed in the low range with 100 volts of potential separating the high and low ranges and constituting the intermediate, undeveloped range. In this situation, from 0 to about 100 volts may separate the high level of potential from the intermediate level of potential, and from 0 to about 100 volts may separate the intermediate level of potential from the low level of potential. When a layered organic photoreceptor is employed, preferred potential ranges are from about −700 to about −850 volts for the high level of potential, from about −350 to about −450 volts for the intermediate level of potential, and from about −100 to about −180 volts for the low level of potential. These values will differ depending upon the type of imaging member selected.

The latent image comprising three levels of potential, hereinafter referred to as a trilevel image, may be formed on the imaging member by any of various suitable methods, such as those illustrated in U.S. Pat. No. 4,078,929, the disclosure of which is totally incorporated herein by reference. For example, a trilevel charge pattern may be formed on the imaging member by the xerographic method of first uniformly charging the imaging member in the dark to a single polarity, followed by exposing the member to an original having areas both lighter and darker than the background area, such as a piece of gray paper having both white and black images thereon. In a preferred embodiment, a trilevel charge pattern may be formed by means of a raster output scanner, optically modulating laser light as it scans a uniformly charged photoconductive imaging member. In this embodiment, the areas of high potential are formed by turning the light source off; the areas of intermediate potential are formed by exposing the imaging member to the light source at partial power; and the areas of low potential are formed by exposing the imaging member to the light source at full power. Other electrophotographic and ionographic methods of generating latent images are also acceptable.

Generally, in the process of the present invention the highlighted areas of the image are developed with a developer comprised of a colored passivated toner having a color other than black, while the remaining portions of the image are developed with the black developer illustrated herein comprised, for example, of resin particles, black pigment particles, such as carbon black like REGAL 330® carbon black, charge control additive, and carrier particles comprised, for example, of a steel core coated with a polymer, such as polymethacrylate, and wherein the coating contains conductive particles, such as known conductive carbon blacks. In general, the highlighted color portions are developed first to minimize the interaction between the two developers, thereby maintaining the high quality of the black image.

Development is generally accomplished by the magnetic brush development process disclosed in U.S. Pat. No. 2,874,063, the disclosure of which is totally incorporated herein by reference. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. For the process of the present invention, the conductive magnetic brush process is generally preferred wherein the developer comprises conductive carrier particles and is capable of conducting an electric field between the biased magnet through the carrier particles to the photoreceptor. Conductive magnetic brush development is generally employed for the process of the present invention in view of the relatively small development potentials of around 200 volts that are generally available for the process; conductive development ensures that sufficient toner is presented on the photoreceptor under these development potentials to result in acceptable image density. Conductive development is also preferred to ensure that fringe fields occurring around the edges of images of one color are not developed by the toner of the other color.

During the development process, the developer housings can be biased to a voltage between the level of potential being developed and the intermediate level of charge on the imaging member. For example, if the latent image comprises a high level of potential of about −800 volts, an intermediate level of potential of about −400 volts, and a low level of about −100 volts, the developer housing containing the colored passivated positively charged toner that develops the high areas of potential may be biased to about −500 volts and the developer housing containing the negatively charged toner that develops the low areas of potential may be biased to about −300 volts. These biases result in a development potential of about −200 volts for the high areas of potential, which will be developed with a positively charged toner, and a development potential of about +200 volts for the low areas of potential, which will be developed with a negatively charged toner. Background deposits are suppressed by keeping the background intermediate voltage between the bias on the color developer housing and the bias on the black developer housing. Generally, it is preferred to bias the housing containing the positive toner to a voltage of from about 100 to about 150 volts above the intermediate level of potential and to bias the housing containing the negative toner to a voltage of from about 100 to about 150 volts below the intermediate level of potential.

The developed image is then transferred to any suitable substrate, such as paper, transparency material, and the like. Prior to transfer, it is preferred to apply a charge by means of a corotron to the developed image in order to charge both toners to the same polarity, thus enhancing transfer. Transfer may be by any suitable means, such as by charging the back of the substrate with a corotron to a polarity opposite to the polarity of the toner. The transferred image is then permanently affixed to the substrate by any suitable means. For the toners of the present invention, fusing by application of heat and pressure is preferred.

Also, the toners and developers of the present invention can be utilized in other color imaging processes, such as process color, and the like. One development process comprises a developer housing with a twin auger transport single magnetic brush design mounted in the approximate 6 o'clock orientation. The color housing the magnetic brush roll (developer roll) is about 30 millimeters in diameter, sandblasted for roughness, and preferably operates at about 1.5 times the speed of the photoreceptor (P/R) or imaging member. The developer roll is spaced about 0.5 millimeter from the photoreceptor and is biased with a square wave 550 volt RMS 2.0 KHz AC bias added to the DC bias which is variable between 0 and −500 volts depending upon the photoreceptor discharge characteristics, and the desired xerographic developability established by the control algorithm. A stationary magnet is situated internal to the rotating developer roll sleeve, and is comprised of a ferrite with a designed magnetic pole configuration to satisfy the requirements of controlling the developer transport and developability. The developer flow (termed Mass on the Sleeve, or MOS) can be controlled by the location of a low permeability trimmer bar in the magnetic field at the point of trimming. Typically, the MOS is set at $33\pm3$ mg/cm$^2$ and is sensitive to the trim gap, toner concentration (TC) and developer tribo; hence, the developer housing has a toner concentration sensor as part of the process control circuitry. The twin augers in the developer housing sump transport the developer in opposite directions first past the toner dispenser then to the developer pick up region of the developer roll. The augers have slits built into them in order to facilitate the mixing of the fresh toner added to the developer. Usually, a number of latent images are formed and developed sequentially on the imaging member with the appropriate toner of the present invention, depending on the color desired for example.

The black developers comprised, for example, of a positively charged toner with a pigment, such as carbon black, which developers can be comprised of similar components as the aforementioned colored developers, with the exceptions that a black instead of colored pigment is selected, and the charge enhancing additive is, for example, an alkyl pyridinium chloride, and preferably cetyl pyridinium chloride, which is present in an effective amount of, for example, from about 0.1 to about 10 weight percent, and preferably from about 1 to about 5 weight percent, are usually selected for the development of the high potentials. Examples of black developers suitable for the process of the present invention comprise a toner and a carrier. The carrier comprises in an embodiment of the present invention ferrite, steel or a steel core, such as Hoeganes Anchor Steel Grit, with an average diameter of from about 25 to about 215 microns, and preferably from about 50 to about 150 microns, with a coating of chlorotrifluoroethylene-vinyl chloride copolymer commercially available as OXY 461 ® from Occidental Petroleum Company, which coating contains from 0 to about 40 percent by weight of conductive particles homogeneously dispersed in the coating at a coating weight of from about 0.4 to about 1.5 percent by weight. This coating is generally solution coated onto the carrier core from a suitable solvent, such as methyl ethyl ketone or toluene. Alternatively, the carrier coating may comprise a coating of polyvinyl fluoride, commercially available as Tedlar ® from E. I. DuPont de Nemours and Company, present in a coating weight of from about 0.01 to about 0.2, and preferably about 0.05 percent by weight of the carrier. The polyvinyl fluoride coating is generally coated onto the core by a powder coating process wherein the carrier core is coated with the polyvinyl fluoride in powder form and subsequently heated to fuse the coating. In one preferred embodiment, the carrier comprises an unoxidized steel core which is blended with polyvinyl fluoride (Tedlar ®), wherein the polyvinyl fluoride is present in an amount of about 0.05 percent by weight of the core. This mixture is then heat treated in a kiln at about 400° F. to fuse the polyvinyl fluoride coating to the core. The resulting carrier exhibits a conductivity of about $7.6\times10^{-10}$ (ohm-cm)$^{-1}$. Optionally, an additional coating of polyvinylidene fluoride, commercially available as Kynar ® from Pennwalt Corporation, may be powder coated on top of the first coating of the carrier in the black developer at a coating weight of from about 0.01 to about 0.2 percent by weight. The carrier for the black developer generally has a conductivity of from about $10^{-14}$ to about $10^{-7}$, and preferably from about $10^{-12}$ to about $10^{-9}$ (ohm-cm)$^{-1}$. Other carriers may be selected including those of the aforementioned copending applications.

Developer compositions selected for the processes of the present invention generally comprise various effective amounts of carrier and toner. Generally, from about 0.5 to about 5 percent by weight of toner and from about 95 to about 99.5 percent by weight of carrier are admixed to formulate the developer. The ratio of toner to carrier may vary, however, provided that many of the objectives of the present invention are achieved. For example, an imaging apparatus employed for the process of the present invention may be replenished with a colored developer comprising about 55 percent by weight of toner and about 45 percent by weight of carrier. The triboelectric charge of the colored toners generally is from about 10 to about 30, and preferably from about 15 to about 20 microcoulombs per gram, although the value may be outside of this range. Particle size of the colored toners is generally from about 7 to about 20 microns in volume average diameter, and preferably about 13 microns in volume average diameter.

The black positively charged toners of the present invention may also optionally contain as an external additive a linear polymeric alcohol comprising a fully saturated hydrocarbon backbone with at least about 80 percent of the polymeric chains terminated at one chain end with a hydroxyl group. The linear polymeric alcohol is of the general formula $CH_3(CH_2)_nCH_2OH$, wherein n is a number from about 30 to about 300, and preferably from about 30 to about 50, reference U.S. Pat. No. 4,883,736, the disclosure of which is totally incorporated herein by reference. Linear polymeric alcohols of this type are generally available from Petrolite Chemical Company as Unilin TM. The linear polymeric alcohol is generally present in an amount of from about 0.1 to about 1 percent by weight of the toner.

Black developer compositions for the present invention comprise in an embodiment from about 1 to about 5 percent by weight of the toner and from about 95 to about 99 percent by weight of the carrier. The ratio of toner to carrier may vary. For example, an imaging apparatus employed for the process of the present invention may be replenished with a colored developer comprising about 65 percent by weight of toner and about 35 percent by weight of carrier. The triboelectric charge of the black toners generally is from about −10 to about −30, and preferably from about −13 to about −18 microcoulombs per gram, although the value may be outside of this range. Particle size of the black toners is generally from about 8 to about 13 microns in volume average diameter, and preferably about 11 microns in volume average diameter, although the value may be outside of this range, provided that the objectives of the present invention are achieved.

Coating of the carrier particles of the present invention may be by any suitable process, such as powder coating, wherein a dry powder of the coating material is applied to the surface of the carrier particle and fused to the core by means of heat; solution coating, wherein the coating material is dissolved in a solvent and the resulting solution is applied to the carrier surface by tumbling, or fluid bed coating in which the carrier particles are blown into the air by means of an air stream; and an atomized solution comprising the coating material and a solvent is sprayed onto the airborne carrier particles repeatedly until the desired coating weight, from about 1 to about 5 and preferably from about 1 to about 3 weight percent, is achieved.

The toners of the present invention may be prepared by processes such as extrusion, which is a continuous process that entails dry blending the resin, pigment, and charge control additive functioning as a passivating component, placing them into an extruder, melting and mixing the mixture, extruding the material, and reducing the extruded material to pellet form. The pellets are further reduced in size by grinding or jetting, and are then classified by particle size. In an embodiment of the present invention, toner compositions with an average particle size of from about 10 to about 25, and preferably from 10 to about 15 microns are preferred. External additives such as linear polymeric alcohols, silica like AEROSIL ® 972 or zinc stearate are then blended, in effective amounts, such as from about 0.1 to about 1 weight percent, with the classified toner in a powder blender. Subsequent admixing of the toners with the carriers, generally in amounts of from about 0.5 to about 5 percent by weight of the toner and from about 95 to about 99.5 percent by weight of the carrier, yields the developers of the present invention. Other known toner preparation processes can be selected including melt mixing of the components in, for example, a Banbury, followed by cooling, attrition and classification.

The disclosures of each of the United States patents, and copending patent applications mentioned herein are totally incorporated herein by reference.

The following Examples are provided. All parts and percentages are by weight unless otherwise indicated.

EXAMPLE I

A black developer composition was prepared as follows: Ninety-two (92) parts by weight of a styrene-n-butylmethacrylate resin, 6 parts by weight of Regal 330 ® carbon black obtained from Cabot Corporation, and 2 parts by weight of the charge additive cetyl pyridinum chloride were melt blended in an extruder wherein the die was maintained at a temperature of between 130° and 145° C. and the barrel temperature ranged from about 80° to about 100° C., followed by micronization and air classification to yield toner particles of a size of 12 microns in volume average diameter. Subsequently, carrier particles were prepared by solution coating a Hoeganes Anchor Steel core with a particle diameter range of from about 75 to about 150 microns, available from Hoeganes Company, with 0.4 parts by weight of a coating comprising 20 parts by weight of VULCAN ® carbon black, available from Cabot Corporation, homogeneously dispersed in 80 parts by weight of a chlorotrifluoroethylene-vinyl chloride copolymer, commercially available as OXY 461 ® from Occidental Petroleum Company, which coating was solution coated from a methyl ethyl ketone solvent. The black developer was then prepared by blending 97.5 parts by weight of the coated carrier particles with 2.5 parts by weight of the toner in a Lodige Blender for about 10 minutes resulting in a developer with a toner exhibiting a triboelectric charge of +18 microcoulombs per gram as determined in the known Faraday Cage apparatus and a carrier conductivity of $6.6\times10^{-10}$ (ohm-cm)$^{-1}$. Admix time for substantially uncharged added toner comprised of the same components of the above prepared toner was less than 30 seconds as determined in the known spectrograph, reference U.S. Pat. No. 4,375,673, the disclosure of which is totally incorporated herein by reference.

EXAMPLE II

A red developer composition was prepared as follows. Ninety-two (92) percent by weight of styrene butadiene (89/11), 7 percent of the pigment, Lithol Scarlet D3700 TM obtained from BASF, as a negative pigment to impart a negative charge to the toner, and 1 percent by weight of the positive charge control agent distearyl dimethyl ammonium methyl sulfate for passivation of the pigment to a certain tribo, and for desirable admix characteristics, about 30 seconds, were melt blended in an extruder wherein the die was maintained at a temperature of between 130° and 145° C. and the barrel temperature ranged from about 80° to about 100° C., followed by micronization and air classification to yield toner particles of a size of 11.5 microns in volume average diameter. To the surface of the toner particles were then blended 0.3 percent by weight of Aerosil ® R972 and 0.3 percent by weight of zinc stearate. Subsequently, carrier particles were prepared by solution coating a Hoeganes Anchor Steel core with a particle diameter range of from about 75 to about 150 microns, available from Hoeganes Company, with 0.8 part by weight of a coating comprising 20 parts by weight of Vulcan carbon black, available from Cabot Corporation, homogeneously dispersed in 80 parts by weight of polymethyl methacrylate, which coating was solution coated from a toluene solvent. The resulting red developer was then prepared by blending 97.5 parts by weight of the coated carrier particles with 2.5 parts by weight of the red toner in a Lodige Blender for about 10 minutes resulting in a developer with a toner exhibiting a triboelectric charge of −18 microcoulombs per gram as determined in the known Faraday Cage apparatus and a carrier conductivity of $1.5\times10^{-10}$ (ohm-cm)$^{-1}$. Admix time for substantially uncharged added toner comprised of the same components of the above prepared toner was less than 30 seconds as determined in the known spectrograph.

The above red developer and the black developer of Example I were then incorporated into an imaging device equipped to generate and develop trilevel images according to the method of U.S. Pat. No. 4,078,929, the disclosure of which is totally incorporated herein by reference. A trilevel latent image was formed on the imaging member and the low areas of −100 volts potential were developed with the red developer, followed by development of the high areas of −750 volts potential with the black developer, and subsequent transfer of the two-color image to paper, and heat fusing of the image to the paper. Images formed exhibited excellent copy quality with substantially no background for 400,000 imaging cycles. Also, the aforementioned toners exhibited stable triboelectric charging characteristics, that is the triboelectric charging properties remain relatively constant for 400,000 imaging cycles at relative humidities of from 20 to about 80 percent and at temperatures of from about 25° C. to about 70° C. at which time the test was terminated.

Other passivated colored toners, and black toner and developers were prepared by repeating the procedures of Examples I and II with substantially similar results when these toners were selected for the generation and developer of trilevel images according to the method of U.S. Pat. No. 4,078,829, the disclosure of which has been totally incorporated herein by reference. Thus, for example, a cyan toner was prepared by melt mixing in a Banbury 90 weight percent of a styrene butadiene copolymer, 91 percent by weight of styrene and 9 percent by weight of butadiene; 7 percent by weight of Neopen Blue available from BASF Corporation, and 1 weight percent of the charge additive distearyl dimethyl ammonium methyl sulfate. A developer was then prepared by repeating the process of Example II with the same carrier, and there resulted on the toner a charge of −18 microcoulombs per gram, and the admix time for uncharged added toner comprised of the above components was 45 seconds. Further, a blue toner was formulated by repeating the aforementioned procedure with the exception that 90 percent by weight of a Pliotone ® resin, a styrene butadiene resin available from Goodyear Chemical Company, 7 weight percent of PV Fast Blue TM, and 3 percent by weight of the Bontron E-88 TM were selected, and on the surface thereof there was blended 0.3 weight percent of Aerosil R972 ® and 0.3 weight percent of zinc stearate, which blending was accomplished by mixing the surface component with a prepared toner. A developer was prepared by repeating the procedure of Example II and this developer was selected for the trilevel imaging method as disclosed in U.S. Pat. No. 4,078,929 and substantially similar results were obtained.

Various effective amounts of first developer and second developer can be selected for the process of the present invention including, for example, from about 10 to about 90 percent of the first developer and from about 90 to about 10 percent of the second developer, and preferably in an embodiment of the present invention from about 40 to 60 percent of the first colored developer and 60 to 40 percent by weight of the second black developer. Other amounts not specifically mentioned herein can be selected depending, for example, on a number of factors including the specific components selected for the toner and developer, and the like.

EXAMPLE III

A toner and developer are prepared by repeating the process of Example II with the exception that there is selected as the red pigment Lithol Scarlet K 4460 TM, available from BASF, and substantially similar results are obtained. The toner tribo is about a −19 microcoulombs per gram.

EXAMPLE IV

A toner and developer are prepared by repeating the process of Example II with the exceptions that there is selected as the red pigment Lithol Scarlet K 4165 TM, available from BASF, and substantially similar results are obtained. The toner tribo is about a −17 microcoulombs per gram.

EXAMPLE V

A toner and developer are prepared by repeating the process of Example II with the exception that there is selected as the red pigment Lithol Scarlet L 4300 TM, available from BASF, and substantially similar results are obtained. The toner tribo is about a −16 microcoulombs per gram.

EXAMPLE VI

A toner and developer are prepared by repeating the process of Example II with the exception that there is selected as the red pigment Lithol Rubine NBD4573 TM, available from BASF, and substantially similar results can be obtained. The toner tribo is about a −20 microcoulombs per gram.

EXAMPLE VII

A toner and developer were prepared by repeating the process of Example II with the exception that there was selected as the pigment 6.44 weight percent of Lithol Scarlet D3700 TM, and 0.56 weight percent of Hostaperm Pink E TM, obtained from American Hoechst, and less resin thereby totaling 100 percent for the toner components, and substantially similar results were obtained. The toner tribo was a −17 microcoulombs per gram.

EXAMPLE VIII

A toner and developer are prepared by repeating the process of Example II with the exception that there is selected as the pigment 6.4 weight percent of Lithol Scarlet K 4660 TM, and 0.6 weight percent of Hostaperm Pink E TM, obtained from American Hoechst, and substantially similar results can be obtained. The toner tribo was a −17 microcoulombs per gram.

EXAMPLE IX

A blue toner and developer are prepared by repeating the process of Example II with the exceptions that there is selected as the pigment 9 weight percent of Neopen Blue ND802 TM (BASF), 89.5 weight percent of styrene butadiene resin, and 1.5 weight percent of DDAMS charge additive, and substantially similar results can be obtained. The toner tribo is a −18 microcoulombs per gram.

EXAMPLE X

A blue toner and developer are prepared by repeating the process of Example II with the exceptions that there is selected as the pigment 9 percent of Sudan Blue OS TM (BASF), 89.5 weight percent of styrene butadiene resin, and 1.5 weight percent of DDAMS charge additive, and substantially similar results can be obtained. The toner tribo is a −18 microcoulombs per gram.

EXAMPLE XI

A blue toner and developer are prepared by repeating the process of Example II with the exceptions that there is selected as the pigment 9 weight percent of Neopen Blue NB802 TM, 1 weight percent of Hostaperm Pink E TM, 88.5 weight percent of styrene butadiene resin, and 1.5 weight percent of DDAMS charge additive, and substantially similar results can be obtained. The toner tribo is a −17 microcoulombs per gram.

EXAMPLE XII

A blue toner and developer are prepared by repeating the process of Example II with the exceptions that there is selected as the pigment 9 weight percent of Sudan Blue OS TM, 1 weight percent of Hostaperm Pink E TM, 88.5 weight percent of styrene butadiene resin, and 1.5 weight percent of DDAMS charge additive, and substantially similar results can be obtained. The toner tribo is a −17 microcoulombs per gram.

EXAMPLE XIII

A blue toner and developer are prepared by repeating the process of Example II with the exceptions that there is selected as the pigment 9 weight percent of Sudan Blue OS TM, 0.5 weight percent of Lithol Rubine NB 4573 TM, 89 weight percent of styrene butadiene resin, and 1.5 weight percent of DDAMS charge additive, and substantially similar results can be obtained. The toner tribo is a −19 microcoulombs per gram.

EXAMPLE XIV

A blue toner and developer are prepared by repeating the process of Example II with the exceptions that there is selected as the pigment 7 weight percent of PV Fast Blue B2GA TM as a positive charging pigment, available from American Hoechst Corporation, 90 weight percent of styrene butadiene resin, and 3 weight percent of the negative charge additive complex Bontron E-88 TM, available from Orient Chemical Company, and the toner tribo is a −17 microcoulombs per gram.

EXAMPLE XV

A blue toner and developer are prepared by repeating the process of Example II with the exceptions that there is selected as the pigment 7 weight percent of PV Fast Blue B2GA TM as the positive charging pigment, available from American Hoechst Corporation, 90 weight percent of styrene butadiene resin, and 3 weight percent of the negative charge additive Bontron E-44 TM, available from the Orient Chemical Company, and the toner tribo is a −18 microcoulombs per gram.

Embodiments of the present invention include a process for the preparation of passivated toners with a positive or negative triboelectric value of from about 10 to about 30 microcoulombs per gram, which comprises admixing toner resin particles, colored pigment particles, and a charge enhancing additive that can impart a positive charge, or a negative charge to the toner, and subsequently adding thereto surface additives, and whereby the charge additive functions primarily as a passivating component; and a process for the preparation of passivated toners which comprises admixing toner resin particles, colored pigment particles selected from the group consisting of red and blue, and a charge enhancing additive, and subsequently adding thereto surface additives; and wherein the charge additive functions primarily as a passivating component. Also disclosed is the admixing in known effective amounts of known cyan, magenta, and yellow toners, preferably with a common carrier comprised, for example, of steel coated with polymethyl methacrylate and containing conductive carbon black particles, such as 20 weight percent of Vulcan TM carbon black, to obtain process colors like red, blue, green, and the like; for example, yellow and magenta will provide a green toner.

Other embodiments and modifications of the present invention may occur to those skilled in the art subsequent to a review of the present application; these embodiments and modifications, as well as equivalents thereof, are also included within the scope of this invention.

What is claimed is:

1. A process for the preparation of toner compositions consisting essentially of admixing toner resin particles, colored negatively charged pigment particles selected from the group consisting of red and blue, and a positive charge enhancing additive selected from the group consisting of cetyl pyridinium chloride and distearyl dimethyl ammonium methyl sulfate; and subsequently adding thereto surface additives thereby enabling passivation of said pigment particles and wherein there is minimal or no adverse effects on the toner compositions triboelectric characteristics by said pigment particles.

2. A process in accordance with claim 1 wherein the red pigment is Lithol Scarlet D3700 TM, Pigment Red 48:1 TM, or C.I. 15865:1 TM.

3. A process in accordance with claim 1 wherein the blue pigment is a Neopen Blue TM, a Heliogen Blue TM, or a Sudan Blue TM.

4. A process in accordance with claim 1 wherein the pigment is comprised of a mixture of a Sudan Blue TM and a Hostaperm Pink TM; a mixture of a Sudan Blue OIS TM and Lithol Rubine NB04573 TM, or a mixture of a Neopen Blue TM and Lithol Rubine TM.

5. A process in accordance with claim 1 wherein the resin particles are comprised of styrene butadienes.

6. A process in accordance with claim 1 wherein the surface additives are comprised of colloidal silicas.

7. A process in accordance with claim 1 wherein the surface additives are comprised of metal salts of fatty acids.

8. A process in accordance with claim 1 wherein a developer is prepared by admixing the formed toner with carrier particles.

9. A process in accordance with claim 8 wherein the carrier is comprised of a steel core with a coating of a polymer.

10. A process in accordance with claim 9 wherein the carrier coating contains conductive particles.

11. A process in accordance with claim 1 wherein a developer is prepared by admixing the formed toner with carrier particles.

12. A process in accordance with claim 11 wherein the carrier has an average diameter of from about 50 to about 150 microns.

13. A process in accordance with claim 11 wherein the carrier core comprises unoxidized steel.

14. A process in accordance with claim 11 wherein the carrier comprises thereover a coating of methyl terpolymer containing from 0.1 to about 40 percent by weight of carbon black at a coating weight of from about 0.4 to about 1.5 percent by weight of the carrier.

15. A process in accordance with claim 11 wherein the carrier comprises thereover a coating of a mixture of polymethyl methacrylate present in an amount of from about 80 to about 90 percent by weight, and carbon black present in an amount of from about 10 to about 20 percent by weight at a coating weight of about 1 percent by weight of the carrier.

16. A process in accordance with claim 1 wherein the colored toner contains external additives comprising metal salts or metal salts of fatty acids present in an amount of from about 0.1 to about 2 percent by weight of the toner.

17. An imaging process which comprises (1) charging an imaging member in an imaging apparatus; (2) creating on the member a latent image comprising areas of high, intermediate, and low potential; (3) developing the low areas of potential with a first developer comprising carrier and a toner, which toner is prepared by admixing toner resin particles, colored negatively charged pigment particles selected from the group consisting of red and blue, and a positive charge enhancing additive selected from the group consisting of cetyl pyridinium chloride and distearyl dimethyl ammonium methyl sulfate; and subsequently adding thereto surface additives thereby enabling passivation of said pigment particles and wherein there is minimal or no adverse effects on the toner composition triboelectric characteristics by said pigment particles; (4) developing the high areas of potential with a second developer comprising carrier and a second toner comprised of resin, pigment, and a charge enhancing additive; (5) transferring the resulting developed image to a substrate; and (6) fixing the image thereto.

18. A process in accordance with claim 17 wherein the low and high areas of potential are developed by a conductive magnetic brush development system.

19. A process in accordance with claim 17 wherein the imaging member is comprised of a layered organic photoreceptor.

20. A process in accordance with claim 17 wherein the high level of potential is from about −750 to about −850 volts, the intermediate level of potential is from about −350 to about −450 volts, and the low level of potential is from about −100 to about −180 volts.

* * * * *